US006737129B2

(12) United States Patent
Bayer

(10) Patent No.: US 6,737,129 B2
(45) Date of Patent: May 18, 2004

(54) INSULATING GLASS PANE WITH INDIVIDUAL PLATES AND A SPACER PROFILE

(75) Inventor: Franz Bayer, Elzach (DE)

(73) Assignee: Bayer Isolierglas- und Maschinentechnik GmbH, Elzach (DE)

( * ) Notice: Subject to any disclaimer, the term of this patent is extended or adjusted under 35 U.S.C. 154(b) by 0 days.

(21) Appl. No.: 10/276,170

(22) PCT Filed: May 5, 2001

(86) PCT No.: PCT/EP01/05094

§ 371 (c)(1),
(2), (4) Date: Nov. 12, 2002

(87) PCT Pub. No.: WO01/88319

PCT Pub. Date: Nov. 22, 2001

(65) Prior Publication Data

US 2003/0148049 A1 Aug. 7, 2003

(30) Foreign Application Priority Data

May 13, 2000 (DE) ..... 100 23 541

(51) Int. Cl.[7] ..... E06B 3/24; E04C 2/54
(52) U.S. Cl. ..... 428/34; 52/786.13
(58) Field of Search ..... 428/34, 192; 52/786.1, 52/786.13

(56) References Cited

U.S. PATENT DOCUMENTS 3,280,523 A 10/1966 Stroud et al.
4,627,263 A 12/1986 Bayer et al.
5,439,716 A * 8/1995 Larsen ..... 428/34
5,640,815 A 6/1997 Chinzi
5,714,214 A 2/1998 Larsen
5,962,090 A 10/1999 Trautz

FOREIGN PATENT DOCUMENTS

| | | |
|---|---|---|
| DE | 2929544 | 1/1981 |
| DE | 3337058 | 2/1985 |
| DE | 3642567 | 7/1988 |
| DE | 20008654 | 9/2000 |
| EP | 0223511 | 5/1987 |
| EP | 0534175 | 3/1993 |
| FR | 1248713 | 3/1961 |

* cited by examiner

*Primary Examiner*—Donald J. Loney
(74) *Attorney, Agent, or Firm*—Volpe and Koenig, P.C.

(57) ABSTRACT

A spacer profile (3) has two side pads (8) which are provided permanently with a sealing, plastic and elastic material and comprise continuation pads (11). The continuation pads (11) create, at a distance from their adge area (12) connected to a hollow profile, a first bearing point (13) for the individual plates (2), which is preferably in the form of a spacer or a swelling (15), as well as a clearance (14) located between the continuation pad and the individual plate (2) and filled with the sealing material (9). The continuation pads (11) are elastic and exhibit, in their edge area (12) close to the transverse pad (7), a second bearing point (16), which becomes functional when the side plates (2) are subjected to a load in the transverse direction.

15 Claims, 7 Drawing Sheets

INSULATING GLASS PANE WITH INDIVIDUAL PLATES AND A SPACER PROFILE

BACKGROUND

Figure 1:
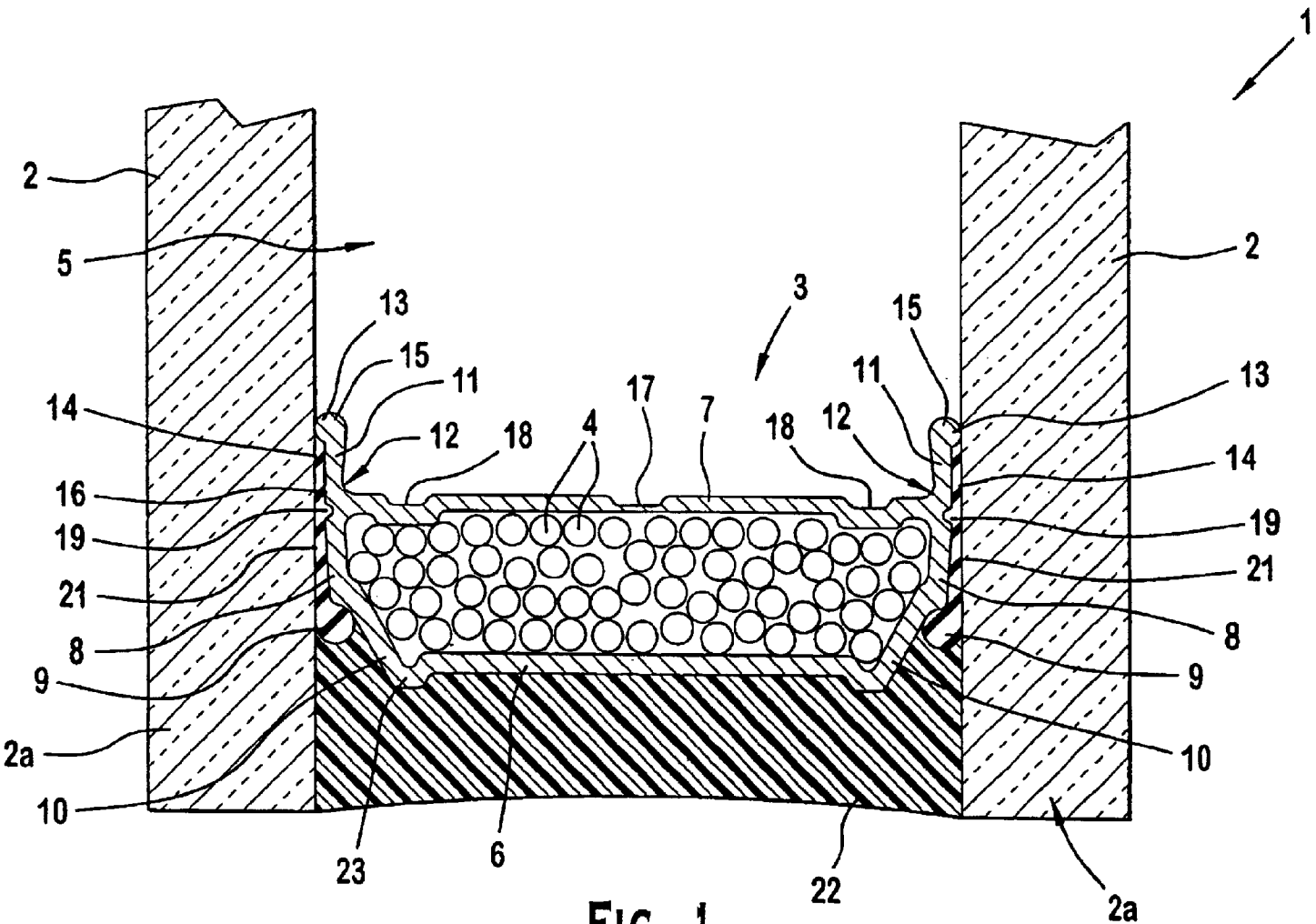

The present invention relates to an insulating glass pane with individual plates and with a space profile as defined in the preamble to Patent claim 1.

An insulating glass pane of this kind is disclosed in U.S. Pat. No. 4,627,263, FIG. 7, and the corresponding description. When the individual plates are pressed together, and when the spacer profile is pressed into position, as well as when the pane is acted upon by wind forces, the sealing compound can be expressed into the interior of the insulating glass pane. This results in edges that are visually unappealing.

U.S. Pat. No. 3,280,523 discloses another type of insulating glass pane, in which the outer transverse pad overlaps the face end edges of the individual panes and no transverse pad is available as a spacer. The inside edges of continuation pads form bearing points for the individual plates, so that under lateral pressure some of the sealing compound is intended to be pressed between the face end edges of the individual plates and the transverse pad that overlaps these. However, in the event that this is prevented by a U-profile that overlaps on the outside it is impossible to preclude expression into the interior of the pane.

U.S. Pat. No. 5,962,090 discloses an insulating glass pane with individual plates and a spacer profile that has no continuation pads. Thus, the benefits that result from such continuation pads are eliminated. The area of the seal is correspondingly narrow, which can then be insufficient if the insulating glass pane is to be filled with gases that are made up of relatively small molecules, for example, noble gases that are desirable for their good insulating properties for the insulating glass pane.

Thus, it is the objective of the present invention to create an insulating glass pane of the type described in the introduction hereto, in which sealing is improved without the need to increase the dimensions of the profile and without the sealant being squeezed out to any notable extent, particularly into the interior of the pane, it being possible to limit excessive movement of the individual plates towards each other in the transverse direction.

SUMMARY

This objective has been achieved by providing an insulating glass pane with individual plates and with a spacer profile, which is formed of a hollow profile that closes off the interior space of the plates along its edges, and which is defined by two transverse pads that are spaced apart and transverse to the planes of the plates. The two side pads are more or less parallel to the planes of the plates and serve, at least in some areas, as supports for the individual plates and are filled with a plastic-elastic sealant. The area that has the sealant is at a different level relative to the individual plates, and there is an inclined transition pad between each outermost transverse pad and the side plates. Each side pad has a continuation pad above the innermost transverse pad that extends towards the interior of the insulating glass pane, which lies against the inner side of the particular individual plate when in its functional position. The continuation pads and the individual plates in the installed position have a space that is filled with sealant, wherein spaced apart from their edge area that is connected to the hollow profile, the continuation pads have a first bearing point for the individual plate, and in that in the area of the side pads or of the edge area that is proximate to the side pad, the spacer profile has a second bearing point for the individual plates which, when the continuation pad pivots elastically comes into contact with the individual plate and which, relative to the side pad or the continuation pad that extends from there to the individual plate, projects less than the first bearing point when the continuation pad (11) is not deformed.

In this way, too, the continuation pads are used so that sealant can be applied to them at least over a part of their width, so that the total width of the area of the spacer profile that is provided with such sealant can be enlarged accordingly. Furthermore, for all practical purposes, none of the sealant could be squeezed out into the interior of the pane if the individual plates move, since this is prevented, at least to a very great extent, by the first bearing point. In the event of extreme deformation of the individual plates and thus of the continuation pads, the sealant that is located on the continuation pads can be cut off from the other sealant that is located on the side pieces and thus be enclosed, which, in the event of excess pressure could, under certain circumstances, lead to a slight although not troublesome displacement through of the first bearing point.

Because of the enlarged area this provided by the arrangement with a sealant according to the present invention, it is also possible to seal insulating glass panes that are filled with a gas other than air, without such gas being able to seep out through of the area of the seal. In particular, gas fillings that are of noble gases, for example, argon, krypton, or xenon, can be used even though they are made up of smaller molecules than air and can thus diffuse more readily.

Because of the second bearing point on the spacer profile, it has been possible to ensure that in the event of pressure that acts in the transverse direction on the insulating glass pane, the continuation pads which are initially the sole direct bearing point of the spacer profile on the individual points—because in the undeformed state the first bearing points form the greatest width of the spacer profile—will be the first to yield, and can pivot towards each other until the individual plates come to rest on the second bearing point in the area of the transverse pad. Thus, any excessive movement of the individual plates towards each other in the transverse direction will be restricted by the transverse pad, or else the transverse forces that are generated will be introduced-at least for the most part-into the transverse pad of the spacer profile.

It is also expedient that the spacer profile be an extruded, hollow profile, in particular of aluminum or of an aluminum alloy, or a rolled hollow profile, in particular of stainless steel sheet, and that the continuation pads be connected thereto so as to form one piece. In the case of both an excluded and of a rolled hollow profile, the continuation pads can be integral parts and be provided with appropriate thickened areas and/or sloping areas, and possess a specific intrinsic elasticity.

Another configuration of the insulating glass pane according to the present invention, in particular, of the spacer profile, can be such that the cross sectional thickness of the continuation pads increases towards their unattached edges or to the thickened area, at least in some areas. By this means, the elastic flexibility of the continuation pads can be enhanced, since the cross section thickness from the first bearing point decreases towards the transverse pad of the spacer profile, where the actual axis of pivot is arranged.

At the same time, it can be expedient that the transverse pad that extends in the area of the second bearing point with its cross section transversely to the individual plates incorporate at least one predetermined buckling point. Under extreme pressure loads, the transverse pad can then also yield to some extent in order to avoid breakage of the individual plate, when the pressure forces can then additionally be distributed onto the outer transverse pad of the spacer profile.

The predetermined buckling point of the transverse pad can be formed by a reduction of its cross sectional thickness and/or by a channel, groove or similar weakening of the material that runs between the transverse pads. In this connection, it is useful if the predetermined of buckling point of the transverse pad be configured and arranged in such a way that this can be deformed or deflected into the interior of the hollow space within the hollow profile. In this connection, the buckling or yielding of the transverse pad can be if restricted by a filling of desiccant to the extent that the spacer profile continues to perform its function.

In order to predetermine the direction of the inward curvature or buckling of the transverse pads into the interior of the hollow profile, the second bearing points on the continuation pads can lie in a plane that is transverse to the individual plates that in the undeformed state more or less coincides with the outer side of the transverse pad and is spaced apart in the direction of the interior of the plate and away from the hollow profile. The transverse pad that is proximate to the interior of the plate, which is meant to curve or buckle inwards somewhat under a high pressure loads, is thus offset somewhat outward relative to the points that are exposed to the pressure load, so that it itself can only be deflected outwards into the hollow space of the hollow profile.

Optionally, the transverse pad can be of a cross sectional shape that is preformed, oriented at least in part into the interior of the hollow space of a hollow profile or which facilitates yielding in this direction, for example, a partial reduction of the cross section, molding in, buckling and/or curving in this direction. Even pressure peaks on the individual plates, which can possibly be generated on insulating glass panes that are installed horizontally in a roof and caused by snow loads or the like, can be rendered harmless without the individual plates immediately breaking or being damaged in the case of such above average loads.

If this results in deformation of the transverse pad that is proximate to the interior of the plate, or in outward curvature or buckling, this is once again supported by a filling of desiccant, so that the desiccant filling performs an additional function.

An area in which the material is weakened, such as a channel, groove, or the like that extends in the longitudinal direction, can be arranged at the approximate level of the transverse pad between the second bearing point on the edge area of the continuation pad that is adjacent to the transverse pad and the side pad; the boundary of this that is proximate to the continuation pad serves as an elastic drag bearing for the continuation pad and is filled, in particular, with sealant.

Because of this, the desired flexibility of the continuation pad can be improved, by being a pivotting action, in order to take account of pressure forces or movements on the individual plates, and the effectiveness of the seal improved; at the same time, a specific reservoir for sealant will be formed.

The channel, groove, or the like that is arranged in the area of the transverse pad can be connected to the intermediate space that is located between the continuation pad and the particular individual plate. This means that in the event of the side pads yielding, the sealant that is located there can move, at least initially, into the channel or groove before this path for the sealant is blocked off or interrupted by the individual plate coming into contact with the second bearing area, as can be the case in the event of even greater deformation. Then, however, the greater part of the sealant has been expressed, so that to a large extent the sealant cannot be squeezed out into the interior of the plate.

One further useful configuration of the insulating glass pane and, in particular, of its spacer profile can be such that—much as in the case of EP 0 534 175 B1—starting from the second bearing point the side pads turn back over a least a part of their cross sectional length relative to the side plate, and together with this form a hollow space, in particular a wedge-shaped space with an acute wedge angle, to accommodate the permanently plasticelastic sealant, and the wedge-shaped hollow space is connected directly or indirectly with the intervening space located between the continuation pad and the particular individual plate. Thus, in the event of movement of the individual panes, the sealant can be expelled to its whole width, depending on the direction of movement and then drawn back once again, so that it adapts dynamically to such movements of the plates; this means that the danger of the sealant being permanently interrupted in some places by such movements is to a large extent precluded. An indirect connection between the wedge shaped hollow space and the space between the continuation pads and the individual pads will result if a channel or groove is arranged between them, whereas there will be a direct connection if there is no such channel or groove.

In the case of the insulating glass pane according to the present invention, it can be useful if an elastic sealing compound be arranged in the area of the transition pads and/or of the outer transition pad; this supports the edges of the two individual plates together with the spacer profile against each other, and covers the hollow space for the remaining plastic-elastic sealant to the outside and closes it off. Because of its elasticity, this sealing compound can contribute to intercepting movements of the individual plates and if, in particular, the insulating glass pane is installed horizontally, it can also help ensure the best possible distribution of pressure loads, so that point loads that could result in breakage of the glass are avoided.

Furthermore, of course, the manner in which the insulating glass pane is sealed is enhanced by such sealing compound, and the permanently plasticelastic sealant is encapsulated and closed off to the outside.

Mainly a combination of the individual features or a plurality of the features and measures described heretofore will result in an insulating glass pane in which the surfaces that are provided with the permanent the plastic-elastic sealant and thus the sealing effect against diffusion are enhanced without enlarging the spacer profile, whilst at the same time the pressure forces acting on the individual plates are intercepted and introduced into the spacer profile incrementally, so that pressure peaks and the danger of glass breakage are to a very large extent avoided.

Figure 2:
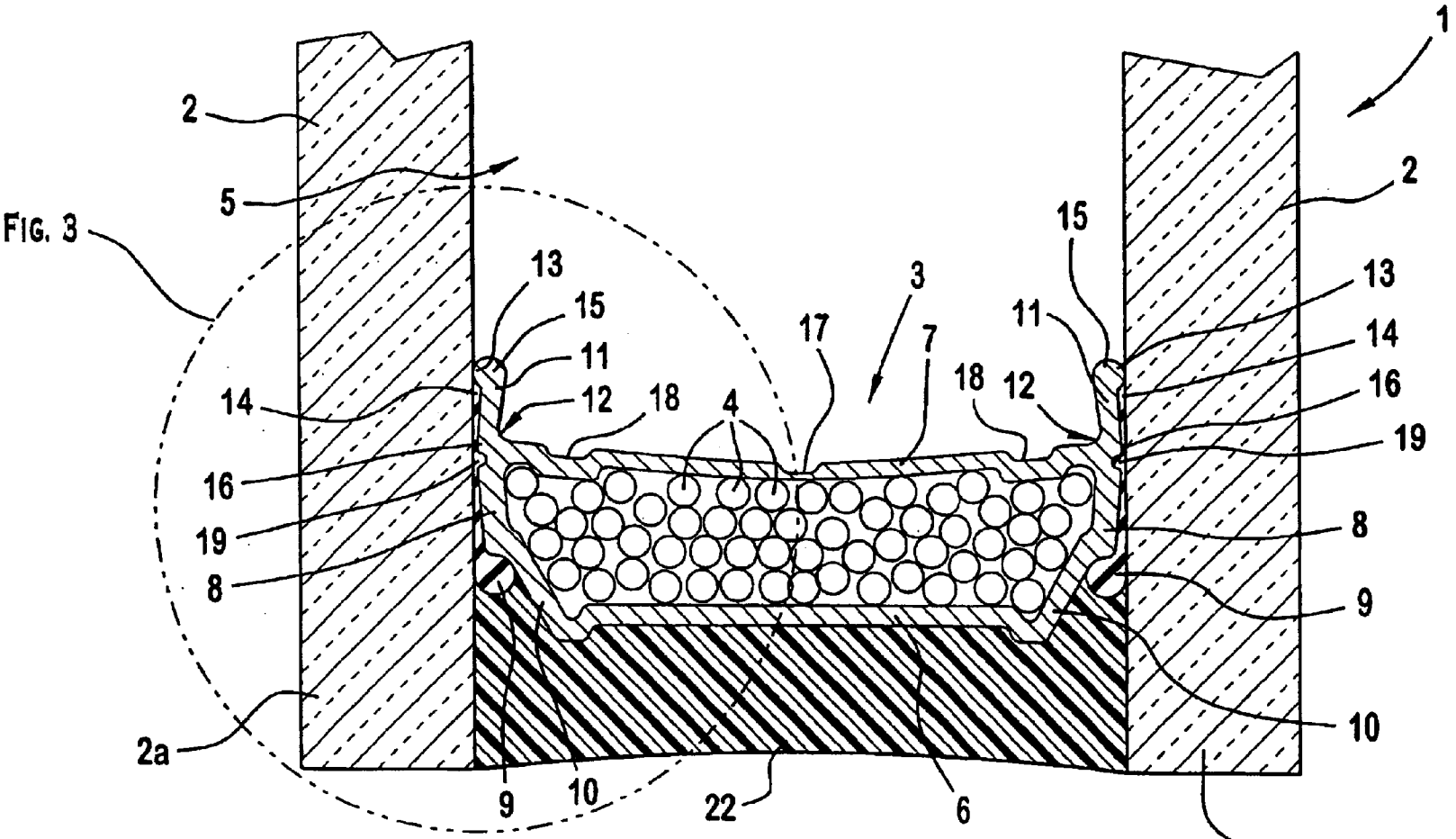
Figure 3:
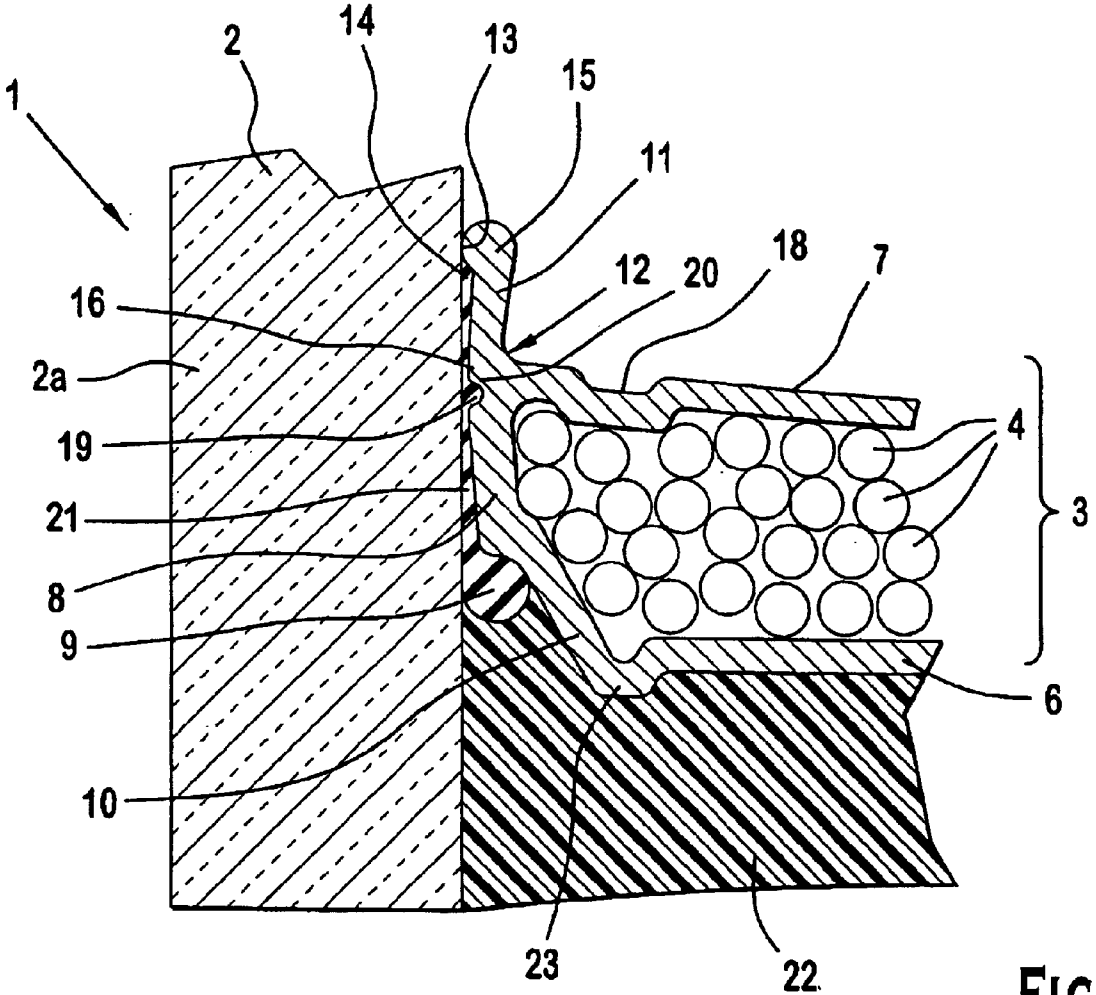
Figure 4:
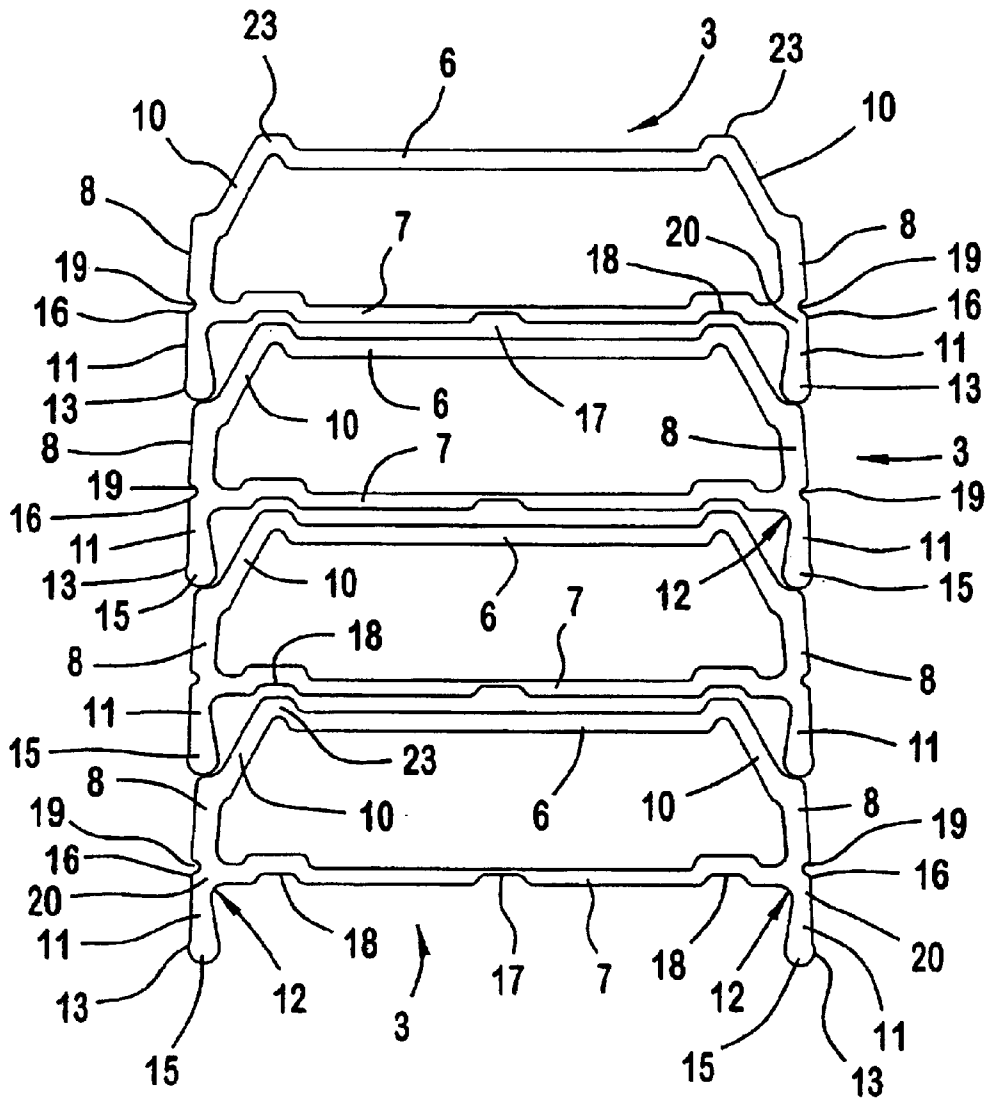
Figure 5:
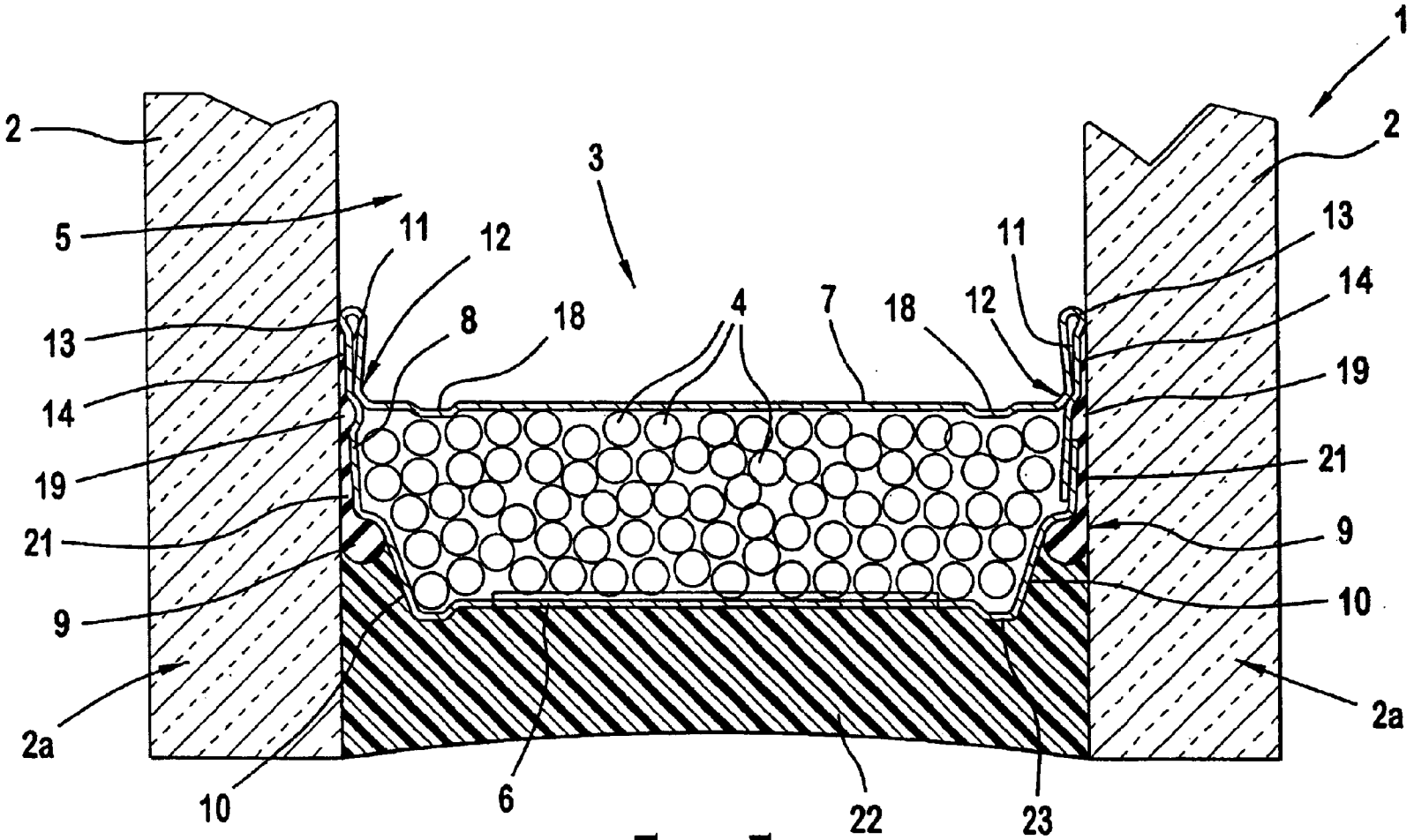
Figure 6:
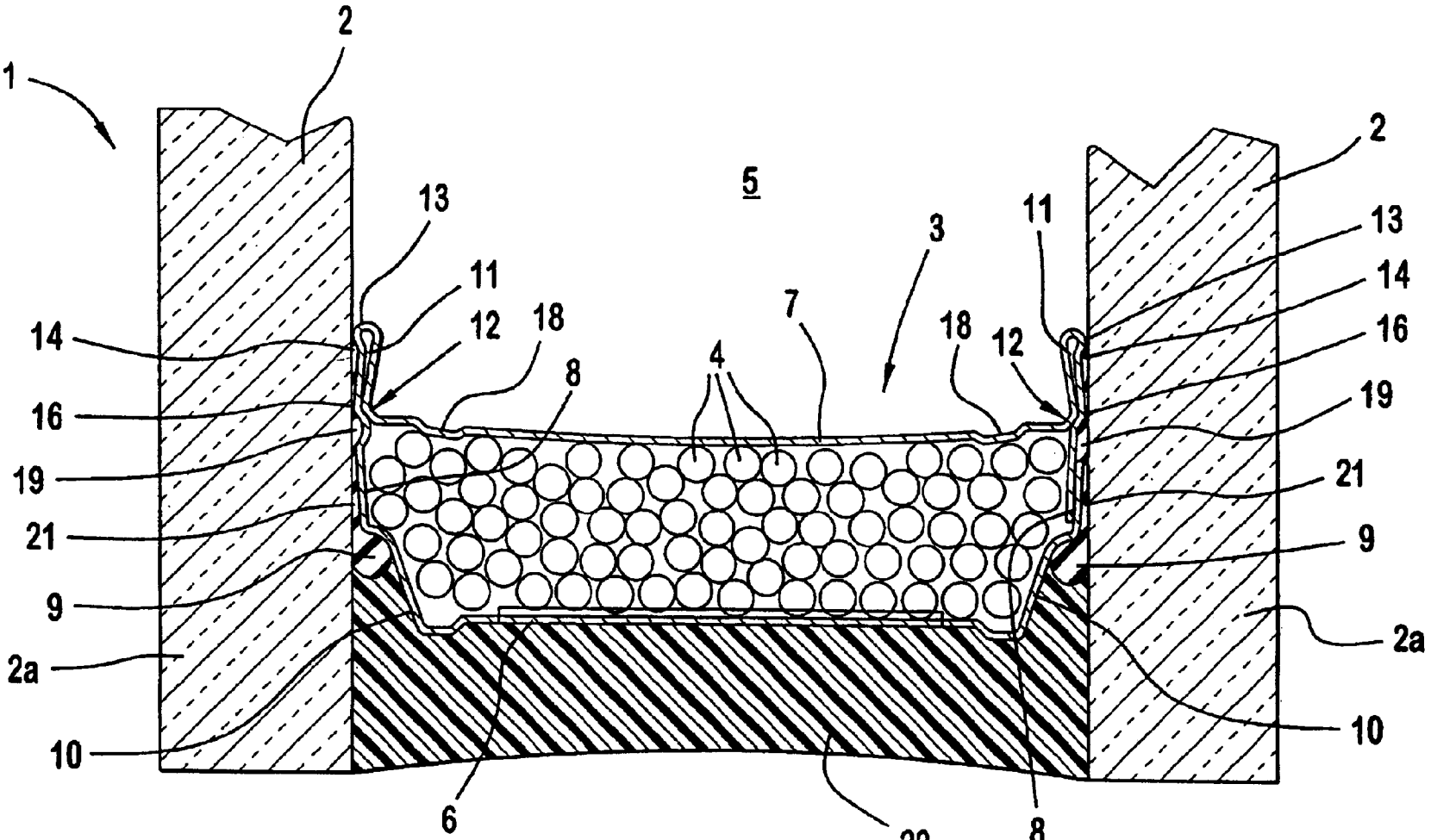
Figure 7:
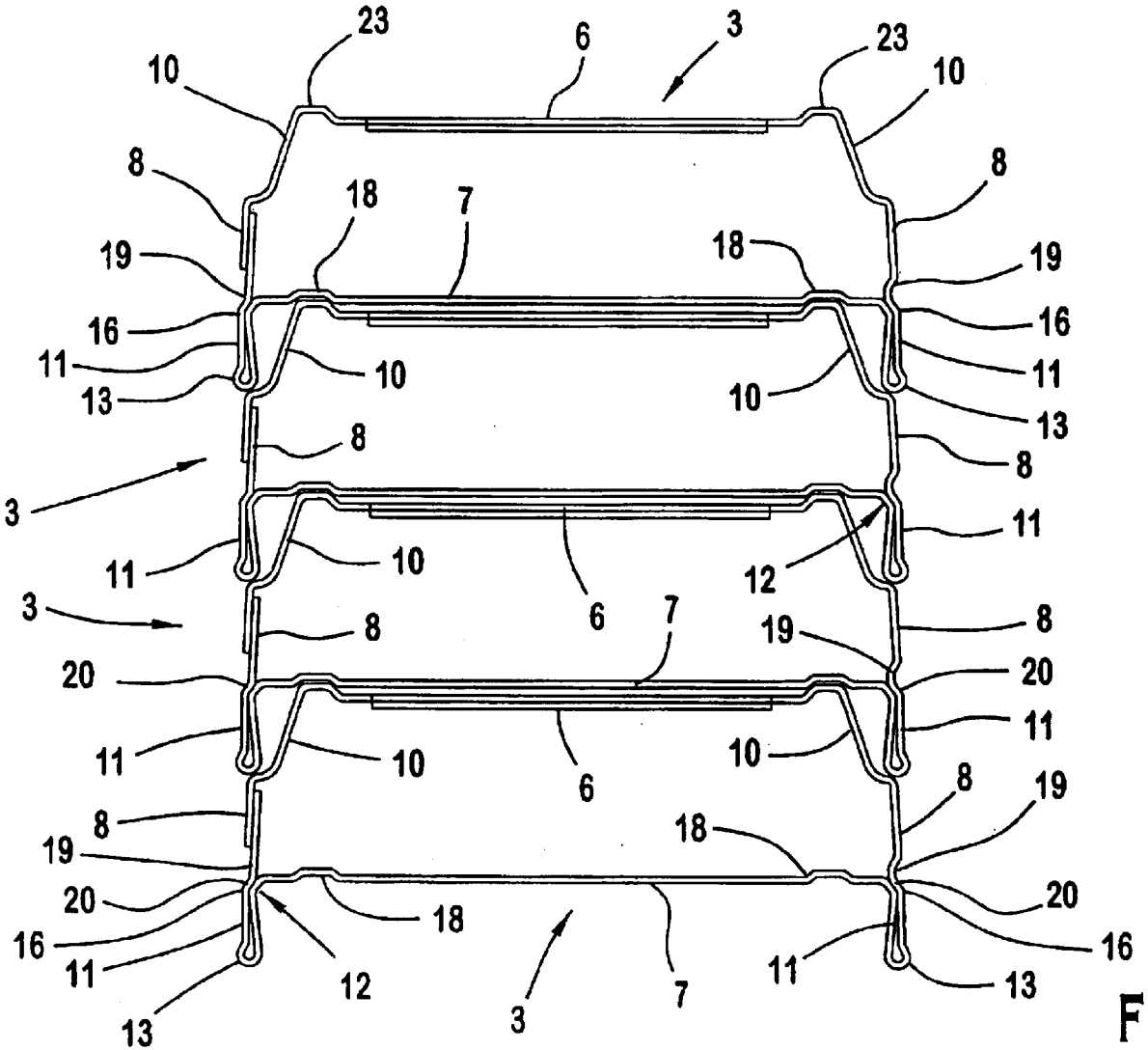

The present invention will be described in greater detail below on the basis of the embodiments shown in the drawings appended hereto. These drawings show the following:

FIG. 1: A cross section through the edge area of an insulating glass pane according to the present invention, with individual plates and with an extruded spacer profile that is a hollow profile that is filled with desiccant, and which has two transverse pads that extend transversely to the plane of the pane and are spaced apart, and two side pads that extend parallel to the planes of the plates, which serve as bearings for the individual plates and which are coated with a permanently plastic-elastic sealant, the side pads being extended toward the interior of the plate by continuation pads, so that the surface coated with the sealing is made wider, since these continuation pads have a first bearing point for the individual plates spaced apart from their edge areas that are connected to the hollow profile;

FIG. 2: A view corresponding to FIG. 1, the continuation pads being pivoted inwards by pressure forces that are generated transversely to the individual plates, so that a second bearing point in the area of the innermost transverse pad comes into contact with the individual plates;

FIG. 3: At greater scale, the details indicated in FIG. 2 by a circle;

FIG. 4: A cross section through a plurality of spacer profiles as shown in FIG. 1 to FIG. 3 that are stacked one above the other, the continuation pads overlapping transition pads that are arranged between the side pads and the outermost transverse pads;

FIG. 5: A view corresponding to FIG. 1, the spacer profile being a rolled hollow profile that is of stainless steel sheet;

FIG. 6: A view, corresponding to FIG. 2, of the arrangement shown in FIG. 5, wherein the side pads have pivoted the continuation pads towards each other because of load or pressure forces acting transversely to them and have deformed these, and in which, in addition, because of these pressure forces, the transverse pad that is closest to the interior of the plate has been curved towards the interior of the hollow profile and supported there by desiccant;

FIG. 7: a cross section through a plurality of rolled spacer profiles that are stacked one above the other.

DETAILED DESCRIPTION OF THE PREFERRED EMBODIMENTS

In the following description of the different embodiments, those parts that perform the same function bear identical reference numbers, even though they may be shaped or configured somewhat differently.

An insulating glass pane, which bears the overall reference number 1, and which is shown in FIG. 1 and FIG. 2, as well as in FIG. 5 and FIG. 6, in each instance in cross section of its edge area, is assembled from two individual plates 2 that are spaced apart and which in their turn can also be compound glass panes or even insulating glass panes. The space between the individual plates is maintained with the help of the spacer profile 3 that consists of a hollow profile filled with desiccant 4, and closes off the pane interior 5 that is located between the individual plates 2, which is to say the space between the individual plates 2, along its edges.

In both embodiments, this hollow profile or spacer profile 3 is defined by two transverse pads 6-outside-and 7-inside-that are spaced apart and extend transversely to the planes of the plates and by side pads 8 that are approximately parallel to the planes of the plates, the side pads 8 serving-in a manner that will be described below—as direct and/or indirect bearings for the individual plates 2 and which are coated with a sealant 9 that remains permanently plastic-elastic, in the area of which the indirect bearing of the individual plates is effected so as to ensure appropriate sealing.

The area that has the sealant 9 is at a different level or spaced apart from the individual pane 2, as can be clearly seen in the figures, and this space is filled with the sealant 9.

Between the outermost transverse pad 6 and the side pads 8 there is in the spacer profiles 3 a transition pad 10 that has its cross section arranged obliquely, as is known, for example, from EP 0 534 175 B1.

The side pads 8 have a continuation pads 11 that extend above the inside of the plate 5 of the insulating glass pane 1 and, similarly, in the installed positioned, these lie either directly or indirectly against the inside of the plates 2 and, as continuations of the side pads 8, can be regarded as belonging to these.

Spaced apart from their edge area 12 that is connected directly to the hollow profile these continuation pads 11 have a first bearing point 13 that provides direct support for the corresponding individual pane 12, so that a space 14 that is filled with sealant 9 is formed between this bearing point 13 and the edge area 12 that is connected to the hollow profile between the continuation pad 11 and the individual pane 2, said space 14 being filled with sealant 9, as can be seen clearly in FIG. 1 and FIG. 5, as well as in FIG. 3. Thus, a direct stop for the individual plate 2 is formed at the first bearing point 13, whereas in the area of the intervening space 14 there is an indirect stop by way of the sealant 9, as is the case in the area of the side pad 8.

In both of the embodiments, the continuation pad 11 has a stop that is formed as the first bearing point 13 and faces the particular individual plate 2, which is configured as a thickened area 15 of the unattached edge of the continuation pad 11 and which, compared to the outermost side of the continuation pad 11 stands proud of this by an amount equal to the intervening space 14 between this continuation pad 11 and the individual plate 2, or forms this intervening space 14.

It would also be possible for the cross section of the continuation pad 11 to extend more less obliquely such that the middle planes of the continuation pads 11 diverge even more towards the free edges.

Provision is made such that relative to the inside transverse pad 7 and thus relative to the actual side pads 8, or relative to their edge area 12 that is connected to these pads, the continuation pads 11 can be pivoted elastically against a restoring force, as can be seen if FIG. 1 is compared with FIG. 2 and FIG. 3 on the one hand, and if FIG. 5 is compared with FIG. 6, on the other. In the event that undesirably high static pressure forces or loads occur on the individual plates 2 in the transverse direction, the individual plates will be moved somewhat towards each other and this can be balanced out and intercepted by the elasticity of the continuation pads so that such transverse loads are attenuated and breakage of the glass is avoided. Such transverse movements can also occur dynamically, if they are caused, for example, by the force of the wind.

In the example shown in FIG. 1 to FIG. 4, the spacer profile 3 is a hollow extruded profile that is, for example, of aluminum or an aluminum alloy. In the examples shown in FIG. 5 to FIG. 7, the spacer profile 3 is a hollow rolled profile that is, for example, made from stainless steel sheet; in both cases the continuation pads 11 are produced or connected so as to form one piece with this spacer profile 3. In the case of the rolled hollow profile, corresponding curves in these continuation pads 11 are formed by appropriate bending as in FIG. 1 and FIG. 2 of EP 0 534 175 B1, whereas in the case of the extruded spacer profile 3, the continuation pads in 11 have a solid cross section, as in DE 33 37 058 C1.

In both cases, every effort is made to ensure that the cross sectional thickness of the continuation pads in 11 increases towards the free edge and towards the thickened area 15, which is to say, in the area of each free edge 12 that is located further to the outside, and which is not free, the continuation pads 12 are a smaller cross section than in the area of the free edge, and of the first bearing point 13. This enhances the flexibility of the continuation pads 11 and the degree to which they can pivot about their edge area 12.

FIGS. 2, 3, and 6 make it clear that the spacer profile 3 has a second bearing point 16 in the area of the side pad 8 or in the area of the edge area 12 of the continuation pad 11 that is proximate to the side pad 8; this second bearing point 16 comes into contact with the individual plate 2 during elastic deformation of the continuation pad 11, and relative to this—when the continuation pad 11 is not deformed—does not project as far from of the outgoing side pad 8 as the first bearing point 13 in the area of the free edge of the continuation pad 11. Thus, the second bearing point 16 first comes into contact with the particular individual plate 2 once the continuation pads 11 have yielded somewhat because of transverse forces or pressure loads. This situation is illustrated in FIGS. 2, 3, and 6, which shows that the individual plates 2 lie directly on both bearing points 13 and 16 because of corresponding loads. It is true that this means that the layer of permanently elastic sealant 9 is pinched off or interrupted briefly and some will be forced out as is described in EP 0 534 175 131; however, the large area sealing surface is maintained, and is reestablished without interruption once the pressure forces are reduced.

In order that even higher pressure forces can be absorbed as far as possible without the danger of the glass breaking, it has been ensured that the inner transverse pad with its cross section running transversely to the individual plates 2 can, in its turn, yield somewhat because its cross section curves inward or bends inward particularly elastically, which imparts additional flexibility to the spacer profile 3 in the transverse direction. To this end, the transverse pad 7 is provided with the least one predetermined buckling point; this is described in greater detail below.

In the embodiment shown in FIGS. 1 to 4, this predetermined buckling point in the transverse pads 7 is, in the first instance, formed by a reduction in the thickness of its cross section in its middle area, which is to say by a channel or groove 17 or the like that weakens the material at this point. Furthermore, relative to its outer edge areas overall, it can also have an area of smaller cross sectional thickness that is defined, for example, by grooves close to its edge, which in their turn make it easier for the transverse pad 7 to curve or bend inward toward the interior of the hollow profile when under correspondingly greater pressure loads. Grooves 18 of this kind of also provided in the rolled hollow profile shown in FIGS. 5 to 7; FIG. 6 clearly shows that the transverse pads 7 curves towards the interior of the hollow profile. The predetermined buckling point is thus so formed, shaped, or arranged on the transverse pad at 7 that it can be deformed or deflected into the interior of the hollow space, where it is then supported by the desiccant 4 so that excessive bending is prevented and so that—because of its elasticity and the restoring forces—it can move back into its starting position once the corresponding load has been removed.

The second bearing points 16 are arranged on the continuation pads 11 in an imaginary plane that extends parallel to the individual plates 2; when not deformed, this plane coincides more or less with the outside of the inner transverse pad 7 that is proximate to the interior of the plate, or even spaced apart in the direction of the interior of the plate and thus from the space within the hollow profile. In the event of appropriate pressure force acting on the second bearing points 16, this will result in corresponding leverage conditions that facilitate and favor the curvature or bending of the transverse pads 7 into the interior of the hollow profile and prevent the transverse pads 7 from bending out in the direction of the interior of pane 5.

This additional flexibility of the spacer profile that results from a corresponding flexibility of the transverse pad 7 is facilitated in that the transverse pads 7 has the above-discussed preformed grooves 18 although another cross sectional shape or cross sectional reduction, curvature, or bending in this direction could also be provided.

Also in FIGS. 1 to 3, it can be seen that the transverse pad 7 has a larger cross sectional thickness close to the grooves 18 that it does in its area that is adjacent to the grooves 17; this favors the curvature of the transverse pad 7 towards the interior of the hollow profile and towards the desiccant 4, as is shown in FIG. 2.

In both of the embodiments, between the second bearing point 16 on the edge area of the continuation pad 11 that is adjacent to the inner transverse pads 7, and the side pad 8 there is at about the level of the inner transverse pads 7 a depression 19 or area where the material is weakened; in the exemplary embodiment, this is a channel or groove that runs in the longitudinal direction. The limit 20 of this that is proximate to the continuation pad 11 serves as an elastic pivot bearing for the continuation pad 11 and is filled with permanently plastic-elastic sealant 9. On the one hand, this enhances the elastic flexibility of the continuation pads 11 and, on the other, increases the supply of sealant 9.

In the case of the rolled spacer profile, one of these depressions 19 is formed by overlapping the original edges of the sheet metal strip from which the rolled hollow profile is made.

In both of the embodiments shown, the depression 19, channel or groove that is arranged in the area of the transverse pads 7 remains connected to the intervening space 14 between the continuation pad 11 and the particular individual plate 3 as long as the continuation pad 11 is not elastically deformed in the transverse direction, which can be seen particularly plainly in FIG. 1 and FIG. 5. This means that the sealant 9 is uninterrupted across the whole width of the cross section of this side pad, including its continuations 11, and can move out of the way during elastic deformation and can also be pressed into this depression 19.

As is the case with the spacer profile described in EP 0 534 175 B1, starting from the second bearing point 16 or from the depression 19, the side pads 8 recede over at least some of the length of the cross section relative to the particular side plate 2 and form a wedge shaped hollow space 21 with these, said wedge shaped space having a wedge angle to accommodate the permanently plastic-elastic sealant; in the same way, this wedge shaped hollow space 21 is connected with the intervening space 14 that is located between the continuation pad 11 and the particular individual plate 3 by way of the depression 19. When the side pads 8 are not deformed, this results in a very wide sealing zone formed by the sealant 9, which also prevents gases with small molecules, such as noble gases, diffusing outwards from the interior of the plate 5. This wide sealing zone is even maintained if the continuation pads 11 yield elastically, because the transverse loads and the sealing zone are interrupted briefly by the second bearing point 16 because it extends on both sides of this second bearing point 16.

In all of the exemplary embodiment shown, it can be seen that in the area of the transition pads 10 and of the outer transverse pads 6 there is another elastic sealing compound 22 that supports the edges 2*a* of the two individual plates 2 together with the spacer profile 3 against each other and covers the hollow space for the permanent plastic elastic sealant 9 to the outside and closes this off; some of this sealing 9 can still be seen in the area of the transition pad 10.

Thus, the sealing mass 22 contributes to the mutual support of the individual plates 2, so that because of its elasticity it can adapt to pressure loads and movements of the individual plates 2 and so that the described flexibility of the spacer profile 3 is also possible.

FIGS. 4 and 7 show, on the one hand, the spacer profile 3 with the continuation pads 11 that are shaped and arranged in a manner described heretofore, and also show how these space profiles can be stacked so as to save space and so that they interlock with each other. The depression 18 that enhances the flexibility of the innermost transverse pads 7 is also used to this end; this matches a raised portion 23 that is formed at the outer end of the transition pads 10. The continuation pads 11 fit over the transition pads 10 and are of a width that corresponds to the projection of the inclined transition pads 10 into the plane of the plate. In this way, the spacer profiles can be kept very well in stores or storage racks, or in the feed systems for bending machines and the like, in the form of stacks.

The insulating glass pane 1 with two individual plates 2, which are optionally assembled, has a spacer profile 3 in the form of a hollow profile that is filled the desiccant 4 and closes off the interior space between the individual plates 2, which is to say it seals the edges of the interior 5 of the pane. The spacer profile 3 has two transverse pads 6 and 7 that extend transversely to the plane of the plates 2 and are parallel to the individual plates 2, and these are filled with permanently plastic-elastic sealant 9 and incorporate the continuation pads 11 that extend above the inner transverse pad 6 in the direction of the interior 5 of the pane and increase the lateral contact surface for the individual plates 2. These continuation pads 11 have a first bearing point 12 for the individual plates 2, which is spaced apart from them and connected to the hollow profile; this is preferably configured as a spacer or thickened area 15 and results in a space 14 between the continuation pad 11 and the individual pane 2 and this space is similarly filled with desiccant 9. The continuation pads 11 are elastically flexible and have in their edge area 12 that is closest to the transverse pads 7 a second bearing point 16, which becomes functional when the side plates 2 are subjected to a load in the transverse direction.

In FIGS. 1 to 3, FIG. 5, and FIG. 6, it can be clearly seen that the sealant 9 forms a reservoir in the area of the transition pad 10, the volume of which can change when the plate moves as a result of pressure loads. If the individual plates 2 are pressed together, the sealant can be pressed into this reservoir, which is to say that the reservoir is enlarged somewhat, whereas in the opposite case, when the plates 2 return to their former spacing, the sealant 9 flows back into the wedge shaped hollow space 21, the depression 19, and the space of 14 to the extent that it was previously expressed therefrom.

In this connection, it is advantageous that this is reservoir be sealed off hermetically from the sealing compound 22 so that expulsion can take place not only in the direction of the cross section, but also in the longitudinal direction of the spacer profile.

It is thus possible that pressure forces act only on one part area of the spacer profile, for example, on the corner area so that the sealant is then displaced plastically not only into the reservoir but also in the longitudinal direction of the hollow profile, so that sealant 9 that is expressed then returns once again into its starting position when such excessive pressure is released.

What is claimed is:

1. Insulating glass pane (1) with individual plates (2) and with a spacer profile (3), which is formed of a hollow profile which closes off an interior space (5) of the plates (2) along edges of the pane, the spacer profile is defined by two transverse pads (6, 7) that are spaced apart and transverse to planes of the plates, and by two side pads (8) that are generally parallel to the planes of the plates; the side pads (8) serve, at least in some areas, as supports for the individual plates (2) and are filled with a plastic-elastic sealant (9), an area that has the sealant (9) being at a different level relative to the individual plates (2), with an inclined transition pad (10) being located between the outermost transverse pad (6) and the side plates (8), each of the side pads (8) having a continuation pad (11) above the innermost transverse pad (7) that extends towards the interior (5) of the insulating glass pane (1), which lies against an inner side of the respective individual plate (2) in a functional position thereof, a space (14) is located between the continuation pads (11) and the individual plates (2) in an installed position that is filled with the sealant (9), wherein spaced apart from an edge area (12) that is connected to the hollow profile, the continuation pads (11) have a first bearing point (13) for each of the individual plates (2); and in an area of the side pads (8) or of the edge area (12) that is proximate to the side pad (8), the spacer profile (3) has a second bearing point (16) for the individual plates (2) which, when the continuation pad pivots elastically, comes into contact with the respective individual plate (2) and which, relative to the side pad (8) or the continuation pad (11) that extends from there to the individual plate (2) projects less than the first bearing point (13) when the continuation pad (11) is not deformed.

2. Insulating glass pane as defined in claim 1, wherein as the first bearing point (13) the continuation pad (11) incorporates a spacer or a thickening (15) that is proximate to the respective individual plate (2) that is formed that, relative to the outside of the continuation pad (11), stands proud of the individual plate (2) by an amount that is equal to the intervening space (14) formed between the continuation pad (11) and the individual pane (2), or by a cross sectional thickness thereof.

3. Insulating glass pane as defined in claim 1, wherein relative to the respective side pad (8) or an imaginary extension of the side pad (8), as viewed in cross section, an outer side of the continuation pad (11) extends at an acute angle or slightly obliquely so that the surfaces of the two continuation pads (11) that are in each instance proximate to the individual plates (2) diverge towards their free edges; and the free edge of the respective continuation pad (11) and/or a thickened area (15) that is arranged there serves as the first bearing point (13) for the individual plate (2).

4. Insulating glass pane as defined in claim 1, wherein the continuation pads (12) can move elastically relative to the transverse pad (7) and/or relative to the side pads (8) of the hollow profile.

5. Insulating glass pane as defined in claim 1, wherein the spacer profile (3) is an extruded hollow profile formed of aluminum or of an aluminum alloy, or a rolled hollow profile formed from stainless steel sheet; and the continuation pads (11) are connected therewith so as to form one piece.

6. Insulating glass pane as defined in claim 1, wherein the cross sectional thickness of the continuation pads (11) increases towards a free edge thereof or towards the thickened area (15), at least in some areas.

7. Insulating glass pane as defined in claim 1, wherein the transverse pad (7) that extends in an area of the second bearing point (16) with its cross section transverse to the individual plates (2) incorporates at least one predetermined buckling point.

8. Insulating glass pane as defined in claim 7, wherein the predetermined buckling point in the transverse pad (7) is formed by a reduction of a cross sectional thickness and/or a channel, groove (17) or a weakening of the material.

9. Insulating glass pane as defined in claim 7, wherein the predetermined buckling point in the transverse pad (7) is so configured and arranged that the transverse pad (7) can be deformed or deflected into an interior of the hollow profile.

10. Insulating glass pane as defined in claim 1, wherein the second bearing points (16) are situated on a plane that is transverse to the individual plates (2), which in the undeformed state approximates an outer side of the transverse pad (7) and is spaced towards the interior space (5) of the pane and away from the hollow profile.

11. Insulating glass pane as defined in claim 1, wherein the transverse pad (7) incorporates a preformed cross sectional shape that is directed at least in some areas into an interior space of the hollow profile or which facilitates yielding in this direction by including a partial reduction of its cross sectional area, a depression (18), or bending and/or curvature in this direction.

12. Insulating glass pane as defined in claim 1, wherein between the second bearing point (16), on the edge area (12) of the continuation pad (11) that is adjacent to the inner transverse pad (7), and the side pad (8) there is a depression (19) or area of weakened material formed by a channel or groove that runs in a longitudinal direction, that is approximately at a level of the transverse pad and (7) on an outside of the spacer profile, a limit (20) of which that is proximate to the continuation pad (11) serving as an elastic pivot bearing for the continuation pad (11) is filled with sealant (9).

13. Insulating glass pane as defined in claim 12, wherein the depression (19), channel, or groove that is located in the area of the transverse pad (7), on the outside thereof, is connected to the intervening space (14) that is located between when the continuation pad (11) and the respective individual plate (2).

14. Insulating glass pane as defined in claim 1, wherein starting from the second bearing point (16), the side pads (8) draw back at least on one part of their cross sectional length relative to the side plates (2) to form a hollow space (21) which is wedge shaped with an acute wedge angle for accommodating permanently plastic-elastic sealant (9); and the wedge-shaped hollow space (21) is connected either directly or indirectly with the intervening space (14) that is located between the continuation pad (11) and the respective individual plate (2).

15. Insulating glass pane according to claim 14, wherein in an area of the transition pads (10) and/or of the outer transverse pad (6) there is elastic sealing compound (22) that, together with the spacer profile (3), supports the individual plates (2) against each other and covers the hollow space (21) for and seals it off to the outside.

* * * * *